US008419666B2

(12) United States Patent
Liu et al.

(10) Patent No.: US 8,419,666 B2
(45) Date of Patent: Apr. 16, 2013

(54) COMPRESSION SLEEVE

(75) Inventors: Tsung-Hsi Liu, Taipei (TW); Tsung-Hsuan Liu, Taipei (TW)

(73) Assignee: Caremed Supply, Inc., New Taipei (TW)

( * ) Notice: Subject to any disclaimer, the term of this patent is extended or adjusted under 35 U.S.C. 154(b) by 875 days.

(21) Appl. No.: 12/564,929

(22) Filed: Sep. 23, 2009

(65) Prior Publication Data

US 2011/0071447 A1 Mar. 24, 2011

(51) Int. Cl.
*A61H 9/00* (2006.01)

(52) U.S. Cl.
USPC ..... 601/151; 601/148; 128/DIG. 20

(58) Field of Classification Search ..... 601/148–152; 602/13; 606/201, 202; 128/DIG. 20
See application file for complete search history.

(56) References Cited

U.S. PATENT DOCUMENTS 506,553 A 10/1893 Samuels
517,695 A 4/1894 Heil
523,147 A 7/1894 Kilmer
5,626,556 A * 5/1997 Tobler et al. ..... 601/151
5,795,312 A * 8/1998 Dye ..... 601/151
6,231,532 B1 5/2001 Watson et al.
6,610,021 B1 8/2003 Bock
7,285,125 B2 10/2007 Viola
7,442,175 B2 10/2008 Meyer et al.
2005/0070828 A1 3/2005 Hampson et al.
2005/0187503 A1 8/2005 Tordella et al.
2008/0004641 A1 1/2008 Viola
2008/0249440 A1 10/2008 Avitable et al.
2008/0249441 A1 10/2008 Avitable et al.
2008/0249443 A1 10/2008 Avitable et al.
2008/0249444 A1 10/2008 Avitable et al.
2008/0249449 A1 10/2008 Brown et al.
2008/0249455 A1 10/2008 Brown et al.
2008/0249559 A1 10/2008 Brown et al.
2009/0062703 A1 3/2009 Meyer et al.
2009/0177222 A1 7/2009 Brown et al.

* cited by examiner

*Primary Examiner* — Quang D Thanh
(74) *Attorney, Agent, or Firm* — CKC & Partners Co., Ltd.

(57) ABSTRACT

A compression sleeve includes a first sheet, a second sheet, at least one close-loop sealing contact and at least two open-loop sealing contacts. The at least one close-loop sealing contact is formed between the first and second sheet so as to form an isolated inflatable section within the close-loop sealing contact. The at least two open-loop sealing contacts are disposed within the at least one close-loop sealing contact, wherein at least one of the at least two open-loop sealing contacts includes two through holes respectively at two opposite ends.

17 Claims, 4 Drawing Sheets

COMPRESSION SLEEVE

BACKGROUND

1. Field of Invention

The present invention relates generally to a compression sleeve for use in a system for applying compressive forces or pressure to a patient's limb.

2. Description of Related Art

The velocity of blood flow in a patient's leg is known to decrease during confinement in bed. Such pooling or stasis of blood is particularly pronounced during surgery, immediately after surgery, and when the patient has been confined to bed for an extended period of time. Additionally, blood stasis is a significant cause leading to the formation of thrombi in the patient's leg, which may eventually cause serious injury or even death. Additionally, in certain patients, it is desirable to move fluid out of interstitial spaces in extremity tissues in order to reduce swelling associated with edema in the extremities. By enhancing the circulation in the limb, the arterial and venous blood flow could be improved.

Intermittent pneumatic compression devices are used to improve circulation and minimize the formation of thrombi in the limbs of patient. These devices typically include a compression sleeve or garment, which wraps around the patient's limb. The sleeve has one or more separate inflatable chambers which are connected to a source of compressed fluid, generally air. The chambers are inflated to provide a compressive pulse to the limb, thereby increasing blood circulation and minimizing the formation of thrombi. In a multi-chambered sleeve, the compression pluses typically around the portion of the limb farthest from the heart, for example, the ankle, and progress sequentially toward the heart. The chamber or the chambers are maintained in the inflated state for a predetermined duration, and all the chambers are depressurized simultaneously. After another predetermined period of time, the compression pulse repeats. With repeating compression pulses, blood is flowed sequentially toward the heart.

SUMMARY

In one aspect of this invention, a compression sleeve includes a first sheet, a second sheet, at least one close-loop sealing contact and at least two open-loop sealing contacts. The at least one close-loop sealing contact is formed between the first and second sheet so as to form an isolated inflatable section within the close-loop sealing contact. The at least two open-loop sealing contacts are disposed within the at least one close-loop sealing contact, wherein at least one of the at least two open-loop sealing contacts includes two through holes respectively at two opposite ends.

In another aspect of this invention, a compression sleeve includes a first sheet, a second sheet, at least one close-loop sealing contact and four open-loop sealing contacts. The at least one close-loop sealing contact is formed between the first and second sheet so as to form an isolated inflatable section within the close-loop sealing contact. The first open-loop sealing contact includes two first through holes respectively at two opposite ends. Two second open-loop sealing contacts each include an end connected to the at least one close-loop sealing contact and an opposite end having a second through hole, wherein the two second open-loop sealing contacts are arranged generally along a virtual line. A third open-loop sealing contact includes an end connected to the at least one close-loop sealing contact and an opposite end having a third through hole. All the first, second and third open-loop sealing contacts are within the at least one close-loop sealing contact and in parallel with an elongate axis of the isolated inflatable section.

Thus, the compression sleeve could have multi-chamber-inflatable-like performance with less necessary fluid conduits, thereby reducing manufacturing costs but enhancing effectiveness of the blood circulation in the patient's limb.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings, FIG. 1A and FIG. 1B respectively illustrate two opposite sides of a compression sleeve according to one embodiment of this invention.

DESCRIPTION OF THE PREFERRED EMBODIMENTS

Figure 1A:
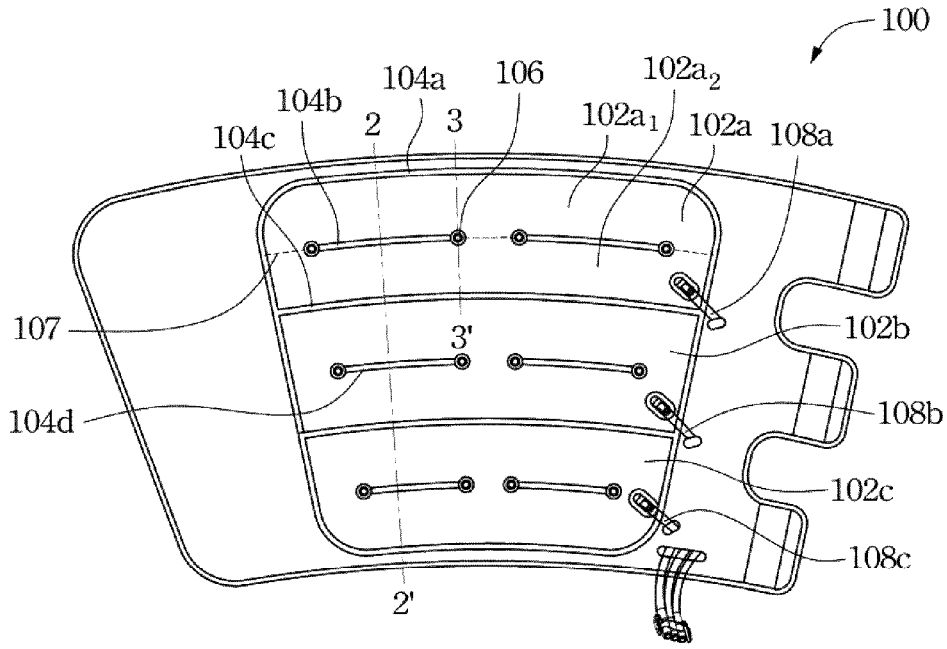

Reference will now be made in detail to the present preferred embodiments of the invention, examples of which are illustrated in the accompanying drawings. Wherever possible, the same reference numbers are used in the drawings and the description to refer to the same or like parts.

Figure 1B:
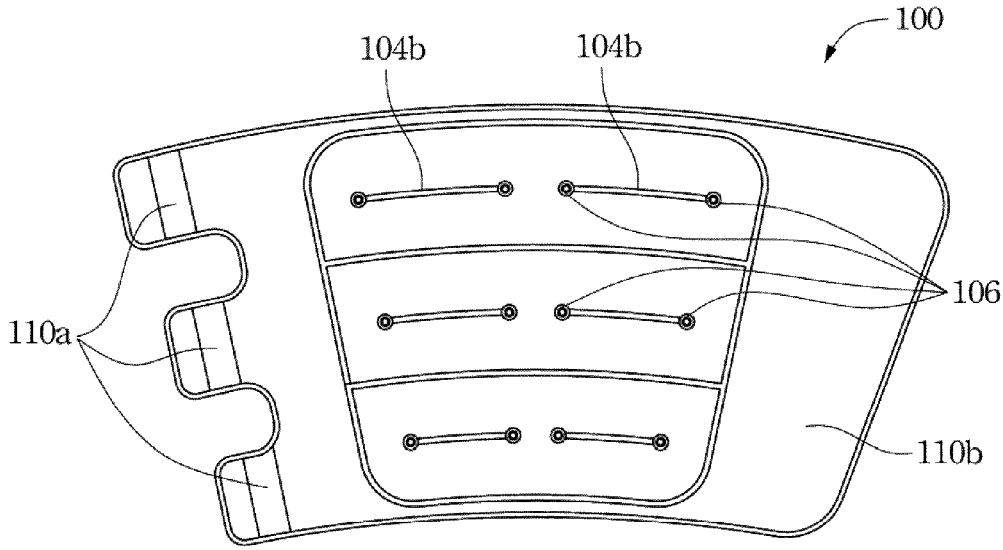

FIG. 1A and FIG. 1B respectively illustrate two opposite sides of a compression sleeve according to one embodiment of this invention. The compression sleeve 100 is to wrap around a patient's limb to apply repeating compression pulses so as to enhance the circulation in the limb. The compression sleeve 100 has three isolated inflatable sections or chambers (102*a*, 102*b*, 102*c*), which are respectively equipped with a conduit (108*a*, 108*b*, 108*c*) connected to a source of pressurized fluid (not illustrated in the drawings). Each isolated inflatable section (102*a*, 102*b*, 102*c*) is formed by and within a close-loop sealing contact, e.g. the sealing contact 104*a* plus the sealing contact 104*c*. In this embodiment, each isolated inflatable section (102*a*, 102*b*, 102*c*) includes two open-loop sealing contacts 1046, which are arranged generally along a virtual line, e.g. 107, to substantially divide each isolated inflatable section into two equal parts, e.g. $\mathbf{102}a_1$, $\mathbf{102}a_2$. Each open-loop sealing contact 104*b* has two through holes 106 respectively at two opposite ends thereof. Two open-loop sealing contacts 104*b* are spaced apart from each other and from the close-loop sealing contact 104*a*. All the through holes 106 are also spaced apart from the close-loop sealing contact 104*a*. Each through hole 106 serves as a ventilation hole, thereby allowing the patient's limb to be "breathed". Each virtual line, e.g. 107, is generally in parallel with an elongate axis of each isolated inflatable section, e.g. 102*a*, 102*b* or 102*c*. The compression sleeve 100 has a plurality of fasteners on two opposite sides thereof, e.g. hook and hoop fastener components (110*a* and 110*b*) adapted for securing the isolated inflatable section or the compression sleeve about a portion of a patient's body.

Figure 2:
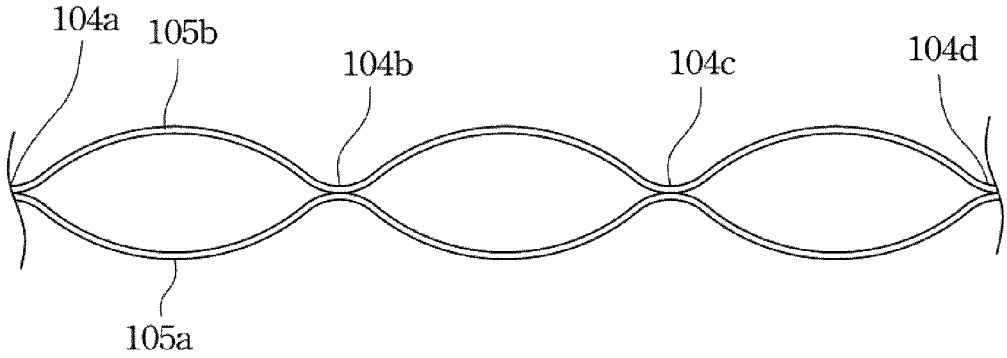
FIG. 2 illustrate a cross-sectional view taken along 2-2' in FIG. 1A.

FIG. 2 illustrate a cross-sectional view taken along 2-2' in FIG. 1A (a part of the cross-section 2-2', not all of the cross-section 2-2'). Two sheets (105*a*, 105*b*) are attached to form inflatable sections therebetween. Sealing contacts (104*a*, 104*b*, 104*c*, 104*d*) are formed by radio frequency welding to form the inflatable sections, which are capable of retaining a pressurized fluid, such as air, in order to exert compressive forces to the patient's limbs during successive pressure-applying cycles. Two sheets (105*a*, 105*b*) may include a suitable flexible polymeric material such as polyvinyl chloride (PVC) on the order of 5-10 mils thick.

Figure 3:
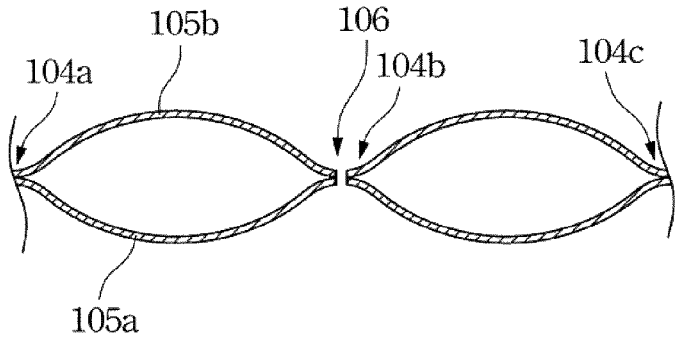
FIG. 3 illustrate a cross-sectional view taken along 3-3' in FIG. 1A.

FIG. 3 illustrate a cross-sectional view taken along 3-3' in FIG. 1A. The through hole 106 on two opposite ends of the sealing contact 104*b* is through two sheets (105*a*, 105*b*), but no air within the inflatable sections (or chambers) will be leaked through the hole 106.

Each isolated inflatable section (102*a*, 102*b*, 102*c*) as discussed above employs the open-loop sealing contacts within to perform as if two inflatable sections are being inflated when each isolated inflatable section is being inflated. However, single one conduit is used to inflate the each isolated inflatable section instead of two conduits. The open-loop sealing contacts are also to control an interval between two sheets (105*a*, 105*b*) when each isolated inflatable section is fully inflated.

Figure 4A:
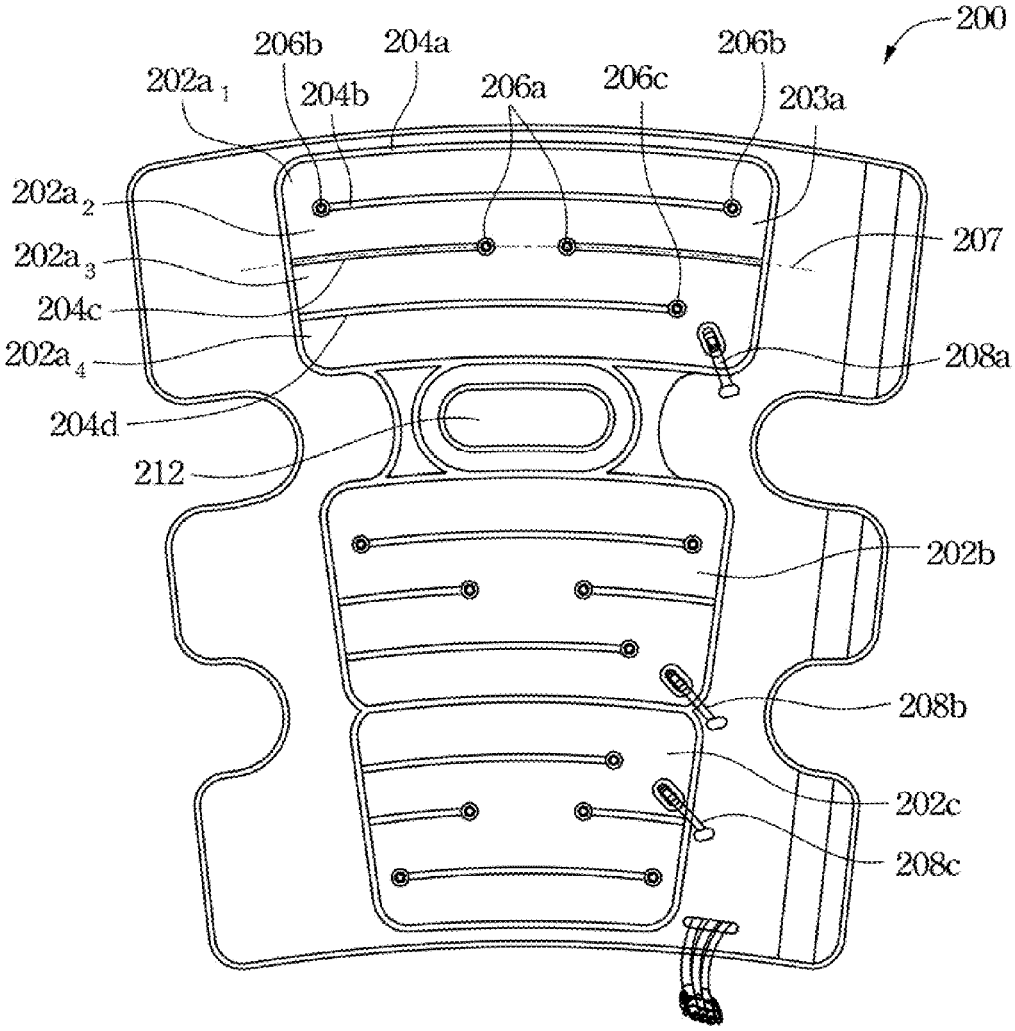
FIG. 4A and FIG. 4B respectively illustrate two opposite sides of a compression sleeve according to another embodiment of this invention.
Figure 4B:
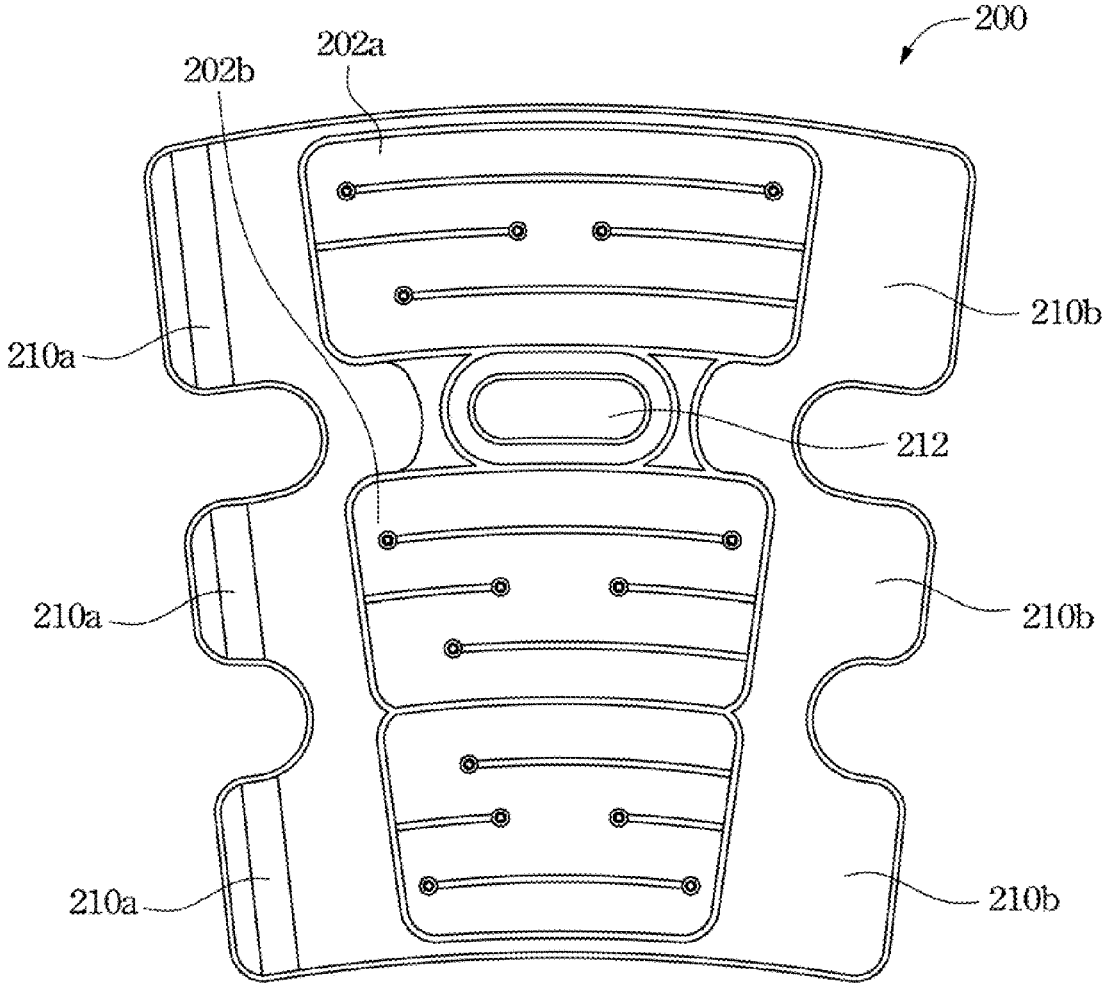

FIG. 4A and FIG. 4B respectively illustrate two opposite sides of a compression sleeve according to another embodiment of this invention. The compression sleeve 200 is to wrap around a patient's limb to apply repeating compression pulses so as to enhance the circulation in the limb. The compression sleeve 200 has three isolated inflatable sections or chambers (202*a*, 202*b*, 202*c*), which are respectively equipped with conduits (208*a*, 208*b*, 208*c*) connected to a source of pressurized fluid, generally air (not illustrated in the drawings). In this embodiment, the isolated inflatable section 202*a* is suitable for wrapping around the patient's upper leg while the isolated inflatable sections (202*b*, 202*c*) are suitable for wrapping around the patient's lower leg. A through hole 212 is designed to expose part of the patient's knee. Each isolated inflatable section (202*a*, 202*b*, 202*c*) is formed by and within a close-loop sealing contact, e.g. sealing contact 204*a*. In this embodiment; each isolated inflatable section (102*a*, 102*b*, 102*c*) includes four open-loop sealing contacts, which substantially divide each isolated inflatable section into four equal parts, e.g. $\mathbf{202}a_1$, $\mathbf{202}a_2$, $\mathbf{202}a_3$, $\mathbf{202}a_4$. In particular, two open-loop sealing contacts 204*c* are arranged generally along a virtual line, e.g. 207, to substantially divide each isolated inflatable section into two equal parts. Each open-loop sealing contact 204*c* include an end connected to the close-loop sealing contact 204*a* and an opposite end having a through hole 206*a*, where two through holes 206*a* are spaced apart from each other and generally located in a central area of each isolated inflatable section. An open-loop sealing contact 204*b* is formed to further divide each isolated inflatable section into further equal parts, e.g. $\mathbf{202}a_1$, $\mathbf{202}a_2$. The open-loop sealing contact 204*b* has two through holes 206*b* respectively at two opposite ends thereof. Another open-loop sealing contact 204*d* is formed to further divide each isolated inflatable section into further equal parts, e.g. $\mathbf{202}a_3$, $\mathbf{202}a_4$. The open-loop sealing contact 204*d* include an end connected to the close-loop sealing contact 204*a* and an opposite end having a through hole 206*c*. Besides, all the first, second and third open-loop sealing contacts (204*b*, 204*c*, 204*d*) are within the close-loop sealing contact 204*a* and in parallel with an elongate axis of the isolated inflatable section 202*a*. Each through hole (106*a*, 106*b*, 106*c*) serves as a ventilation hole, thereby allowing the patient's limb to be "breathed". In this embodiment, the open-loop sealing contacts 204*c* are disposed between the open-loop sealing contact 204*b* and the open-loop sealing contact 204*d*. The virtual line, e.g. 207, is generally in parallel with an elongate axis of each isolated inflatable section, e.g. 202*a*, 202*b* or 202*c*. The compression sleeve 200 has a plurality of fasteners on two opposite sides thereof, e.g. hook and hoop fastener components (210*a* and 210*b*) adapted for securing the isolated inflatable section or the compression sleeve about a portion of a patient's body.

Each isolated inflatable section (202*a*, 202*b*, 202*c*) as discussed above employs the open-loop sealing contacts within to perform as if four inflatable sections are being inflated when each isolated inflatable section is being inflated. However, single one conduit is used to inflate the each isolated inflatable section instead of four conduits. The open-loop sealing contacts are also to control an interval between an upper and an lower sheets of each isolated inflatable section when each isolated inflatable section is fully inflated.

According to discussed embodiments, the compression sleeve could have multi-chamber-inflatable-like performance with less necessary fluid conduits, thereby reducing manufacturing costs but enhancing effectiveness of the blood circulation in the patient's limb.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A compression sleeve comprising:

a first sheet and a second sheet;

at least one close-loop sealing contact formed between the first and second sheet so as to form an isolated inflatable section within the close-loop sealing contact; and at least two open-loop sealing contacts disposed within the at least one close-loop sealing, contact, wherein at least one of the at least two open-loop sealing contacts comprises two through holes respectively at two opposite ends, wherein at least one of the at least two open-loop sealing contacts comprises an end connected to the at least one close-loop sealing contact and an opposite end having a second through hole.

2. The compression sleeve of claim 1, wherein the at least two open-loop sealing contacts are arranged generally along a virtual line, which substantially divides the isolated inflatable section into two equal parts.

3. The compression sleeve of claim 2, wherein, the virtual line is in parallel with an elongate axis of the isolated inflatable section.

4. The compression sleeve of claim 1, further comprising a conduit interconnected between the isolated inflatable section and a source of pressurized fluid.

5. The compression sleeve of claim 1, further comprising a plurality of fasteners comprising hook and hoop fastener components adapted for securing the isolated inflatable section about a portion of a patient's body.

6. The compression sleeve of claim 1, wherein the at least two open-loop sealing contacts are spaced apart from each other and from the at least one close-loop sealing contact.

7. The compression sleeve of claim 1, wherein the two through holes are spaced apart from the at least one close-loop sealing contact.

8. A compression sleeve comprising:

a first sheet and a second sheet;

at least one close-loop sealing contact formed between the first and second sheet so as to form an isolated inflatable section within the close-loop sealing contact;

a first open-loop sealing contact comprises two first through holes respectively at two opposite ends;

two second open-loop sealing contacts each comprising an end connected to the at least one close-loop sealing contact and an opposite end having a second through hole, wherein the two second open-loop sealing contacts are arranged generally along a virtual line; and a third open-loop sealing contact comprising an end connected to the at least one close-loop sealing contact and an opposite end having a third through hole, wherein all the first, second and third open-loop sealing contacts are within the at least one close-loop sealing contact and in parallel with an elongate axis of the isolated inflatable section.

9. The compression sleeve of claim 8, wherein the two second through holes are spaced apart from each other and generally in a central area within the isolated inflatable section.

10. The compression sleeve of claim 8, wherein all the first, second and third open-loop sealing contacts are spaced apart from each other.

11. The compression sleeve of claim 10, wherein the virtual line is disposed between the first and third open-loop sealing contacts and to substantially divide the isolated inflatable section into two equal parts.

12. The compression sleeve of claim 8, further comprising a conduit interconnected between the isolated inflatable section and a source of pressurized fluid.

13. The compression sleeve of claim 8, further comprising a plurality of fasteners comprising hook and hoop fastener components adapted for securing the isolated inflatable section about a portion of a patient's body.

14. The compression sleeve of claim 8, wherein the first open-loop sealing contact is spaced apart from the at least one close-loop sealing contact.

15. The compression sleeve of claim 8, wherein the isolated inflatable section is generally divided into four equal parts by the first, second and third open-loop sealing contacts.

16. The compression sleeve of claim 15, wherein the virtual line is disposed between the first and third open-loop sealing contacts and to substantially divide the isolated inflatable section into two equal parts.

17. The compression sleeve of claim 15, wherein the two second through holes are spaced apart from each other and generally in a central area within the isolated inflatable section.

* * * * *